United States Patent [19]

Bormida, Jr.

[11] 4,353,349

[45] Oct. 12, 1982

[54] RETROFITTABLE ENERGY CONSERVING DAMPER

[76] Inventor: John Bormida, Jr., 610 Sussex Ave., Spring Lake Heights, N.J. 07762

[21] Appl. No.: 216,795

[22] Filed: Dec. 16, 1980

[51] Int. Cl.[3] ..... F24H 3/00; F23L 3/00

[52] U.S. Cl. ..... 126/112; 98/116; 126/285 R; 126/290

[58] Field of Search ..... 126/110 A, 112, 285 R, 126/290; 98/116, 117, 48; 237/48; 236/17, 15 R; 431/12, 20, 90

[56] References Cited

U.S. PATENT DOCUMENTS

| | | | |
|---|---|---|---|
| 891,900 | 6/1908 | Belvin | 98/48 |
| 1,830,036 | 11/1931 | Mortimer | 126/285 R |
| 2,285,746 | 6/1942 | Sabins | 126/290 |
| 2,448,891 | 9/1948 | Katz | 126/390 |
| 2,823,600 | 2/1958 | Cole | 98/116 |
| 3,204,870 | 9/1965 | Dibert | 126/290 |
| 3,249,038 | 5/1966 | Johnson | 98/116 |
| 3,869,243 | 3/1975 | Creuz | 126/285 R |
| 4,038,963 | 8/1977 | Dingwall | 98/48 |
| 4,184,837 | 1/1980 | Manning | 431/12 |
| 4,292,950 | 10/1981 | Schossow | 126/112 |
| 4,306,538 | 12/1981 | Frieber | 126/290 |

*Primary Examiner*—Daniel J. O'Connor
*Attorney, Agent, or Firm*—Gordon W. Kerr

[57] ABSTRACT

The damper is a hollow sheet metal duct-like device of generally rectangular cross section, and is adapted to fit over the combustion air intake of a furnace blower so that the furnace must obtain its combustion air through said damper. A trap door type valve in the lower surface of device automatically opens in response to the suction of the blower to admit combustion air, and automatically closes due to gravity when said blower is de-energized, to cut off the air supply to the furnace combustion chamber when the furnace is not operating.

1 Claim, 4 Drawing Figures

RETROFITTABLE ENERGY CONSERVING DAMPER

BACKGROUND OF THE INVENTION

This invention relates to energy conservation and more particularly to a damper type device for regulating the combustion air supplied to an oil or gas burning furnace in such a way that while the furnace is operating an optimum amount of combustion air is supplied to the combustion chamber thereof but while the furnace is temporarily shut down between periods of operation, the air supply to the combustion chamber is cut off to minimize heat loss up the flue.

After an oil burner shuts down, its heat exchanger is generally at maximum temperature and heat therefrom can be carried up the chimney and lost through convection currents. When the furnace later re-starts, this lost heat must be replaced resulting in longer periods of furnace operation to achieve a given amount of heat supplied to the area to be heated. As the heat is lost up the chimney, a partial vacuum is created inside the combustion chamber of the furnace. The resulting suction will bring in air along the path of least resistance from the area surrounding the furnace. This path is usually through the combustion air intake system. Most oil burning furnaces include an air blower or fan usually of the centrifugal type for supplying combustion air to the furnace. These blowers normally take the air from the room in which the furnace is located through an annular array of holes forming part of the blower frame. Often a shutter arrangement is provided to control and optimize the amount of air admitted via these holes. Thus, there is an air path through such shutter to the combustion chamber through which air will be sucked to replace the hot air lost up the chimney between periods of oil burner operation.

Several different means have been devised to reduce to eliminated this heat loss. The combustion air blowers have been provided with butterfly type valves at their inputs which are automatically opened by a hydraulic piston and cylinder in response to pressure of the fuel oil resulting from the switching on of the furnace. The butterfly valve is closed by the action of gravity when the oil pump and blower are de-energized, to prevent ambient air from entering the blower input. Such a system is shown in U.S. Pat. No. 2,702,589, issued Feb. 22, 1955. Air blower inputs have also been provided with electrically operated shutters; see U.S. Pat. No. 4,155,699 dated May 22, 1979. By restricting the amount of ambient air entering the combustion chamber through the air blower, the devices of these two patents cut off the air supply which makes the convective heat loss possible. Another approach to this problem has been the use of electrically operated dampers in the furnace flue to cut off the convection currents when the furnace is not operating. These devices pose some safety problems, since a malfunction of the damper which leaves it closed while the furnace is operating will result in backup of smoke into the basement and the house.

The present invention comprises a device which greatly reduces the heat loss described above by means of a simple, fail-safe device which requires no electricity for its operation and can be easily retrofitted to most existing oil burners. The novel damper comprises a valve which opens in response to the suction of the air blower to provide the furnace with combustion air, and closes due to gravity when this suction stops as the blower is de-energized.

SUMMARY OF THE INVENTION

The invention comprises a metal chamber which is designed to fit over the annular air shutter which comprises the combustion air intake of the oil burner, so that the combustion air must reach the furnace through the chamber. The bottom wall of the chamber includes a hinged trap door or valve which opens to admit combustion air in response to the suction of the air blower, the suction of which is communicated to the interior of the chamber through the air shutter. Thus the trap door valve remains open as long as the blower is operating. An adjustable screw provides an adjustable stop for the valve so that the amount of air reaching the blower input can be controlled to provide an optimum air to fuel ratio in the combustion chamber. The novel device may comprise a sheet metal duct of rectangular cross section with two semicircular cutaway sections in each of the broad walls thereof at one end of the duct and with the narrow walls at the same end extended and bent into a semicircle, to form a circular recess with the aforementioned semicircular cutaway sections. The extended narrows walls of the chamber can be spread apart during installation and forced over the aforementioned cylindrical air shutter of an oil burner and clamped thereon, so that the air shutter must receive its air through the attached chamber.

It is thus an object of this invention to provide a simple, reliable, and safe damper device for cutting off the supply of air to the combustion chamber of a furnace during periods of non-operation thereof.

Another object of the invention is to provide a means for reducing convective heat loss up the chimney of a furnace during period of non-operation thereof by attaching a chamber or plenum to the air intake of the furnace in such a way that the furnace must obtain its combustion air through said chamber or plenum and providing said chamber or plenum with a trap door type valve which is opened to admit combustion air by the suction of the air blower of the furnace and closes due to gravity when said air blower is de-energized.

Further objects and advantages of this invention will become apparent from the following detailed descreption and drawings.

DETAILED DESCRIPTION OF A PREFERRED EMBODIMENT

Figure 1:
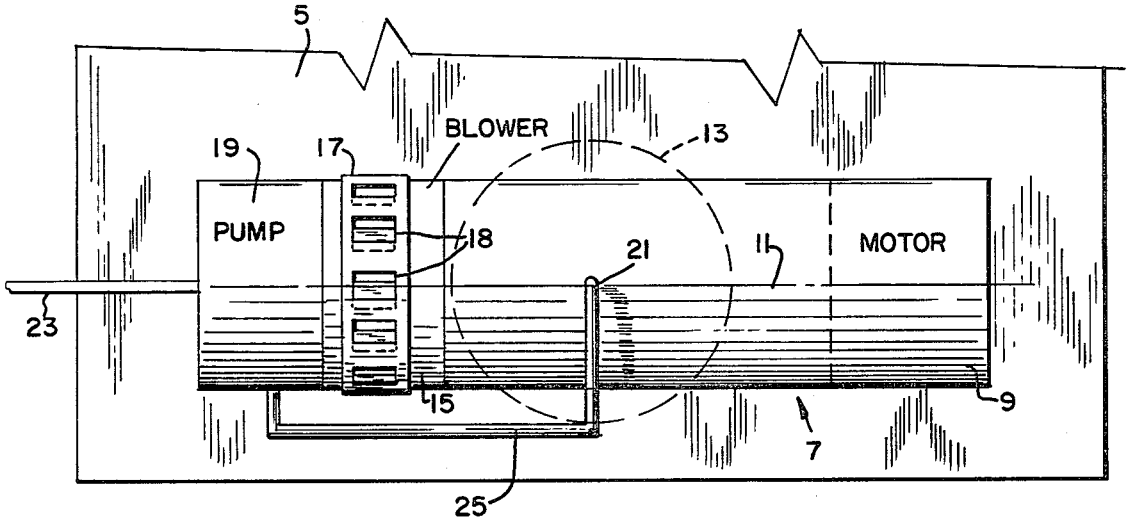
FIG. 1 is an elevational view of the lower portion of a typical oil burning furnace, to which the present invention can be applied.

The furnace of FIG. 1 includes a vertical sidewall 5 which would be either the front or side of the furnace. Mounted on the outside of sidewall 5 and near the bottom thereof is a pump and motor assembly 7 which is generally cylindrical with a horizontal axis. This assembly contains a motor 9, a fan or blower 15, and an oil pump 19. Oil line 23 comes from a fuel tank. The output 25 of the pump 19 is fed into the combustion chamber of the furnace through blast tube 13. The motor operates both the pump and the blower by means of drive shaft 11. The blower supplies combustion air to the furnace through blast tube 13. The combustion air source is the ambient air of the room in which the furnace is located. The air shutter comprising band 17 mounted on the blower frame 15 controls the amount of such air admitted and is adjustable to produce an optimum fuel to air ratio in the combustion chamber. The outer cylindrical frame of blower 15 has a circular array of holes therein. A moveable band 17 with another array of holes 18 therein is mounted over the first array of holes. By moving the band 17 around the circumference of blower 15 over its array of holes, the inner array of holes can be partially blocked in any degree to control the amount of ambient air available to the blower.

Figure 4:
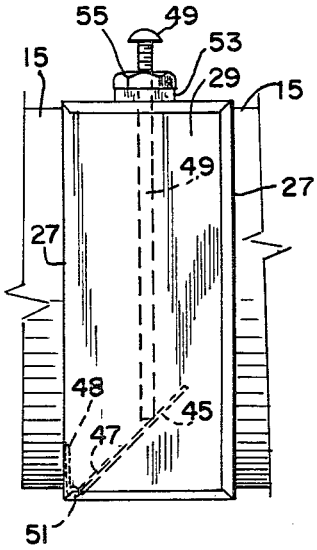
FIGS. 2, 3 and 4 are side, bottom, and end end views, respectively of the present invention retrofitted to the furnace of FIG. 1.
Figure 2:
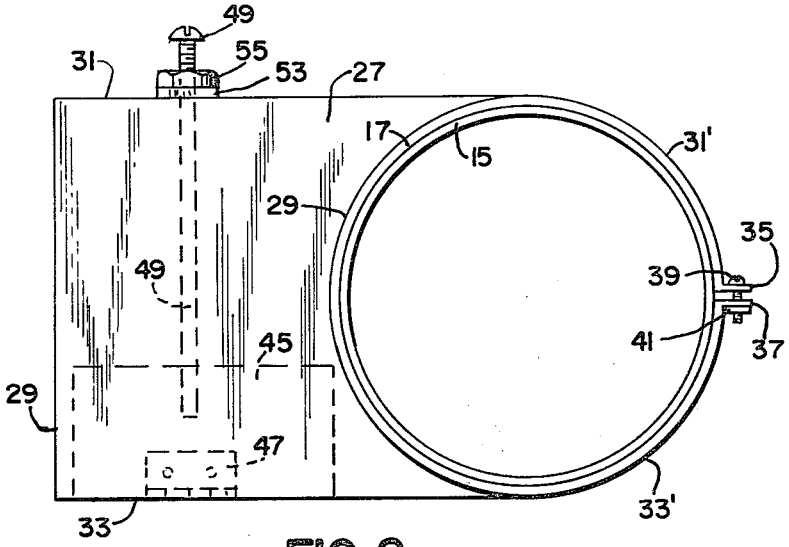
Figure 3:
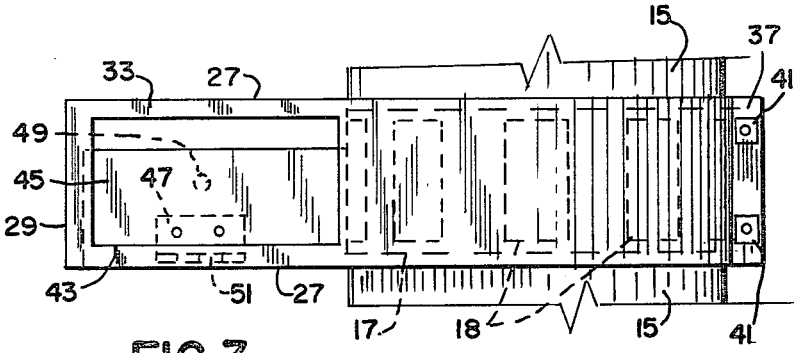

FIGS. 2, 3 and 4 are side, bottom, and end views, respectively, of the present invention retrofitted to the furnace of FIG. 1, for the aforementioned purpose. The illustrative damper device of these figures comprises a hollow chamber formed of sheet metal with a rectangular cross section over most of its length, as seen in FIG. 4. The broad sidewalls 27 of the chamber have a semicircular cutaway section 29 at one end thereof. The radius of this section is just slightly larger than that of the cylindrical body of blower 15. The upper and lower narrow sidewalls of the chamber are indicated at 31 and 33, respectively. These walls have respective extensions 31' and 33' which are bent into a semicircle which compliments the semcircular cutaway section 29 and thus forms a circular opening or recess which can fit over the air shutter of the blower 15. The ends of sidewalls 31' and 33' are bent outwardly at 35 and 37 to form confronting tabs through which a pair of screws and nuts 39 and 41 or other suitable means can be placed to secure the device around the blower input. The entire chamber is made of sheet metal and the extention 31' and 33' can be opened wide enough so that the device will slip over the outer periphery of the blower and then be secured as shown in FIG. 2.

The bottom view of FIG. 3 shows that the air shutter comprising the moveable band 17 and array of holes 18 is surrounded by the circular opening the chamber.

As seen in FIG. 3, the lower narrow sidewall 33 has a rectangular hole 43 therein which with the trap door 45 cooperates to form a valve for admitting combustion air to the furnace and blocking the air thereto while the furnace is shut down. The trap door is hinged to the inside of the chamber by means of hinge plates 47 and 48 and hinge pin 51. The area of the door is slightly larger than the rectangular opening 43, so that gravity normally holds the door closed. As previously stated, operation of the blower 15 will produce a suction inside the chamber which will lift door 45, admitting air for combustion. Before the installation of the chamber, the air shutter of the furnace would be adjusted to its fully opened position. The volume of combustion air is adjustable by means of an adjustable stop which limits the travel of the door 45. This adjustment can take the form of a screw 49 which projects into the chamber interior above the door through a threaded portion of the upper narrow wall 31. This threaded portion may comprise merely a nut 53 which is secured by solder or other means to sidewall 31 over a hole therein and the screw 49 inserted therein an amount to provide a stop for door 45 at a position which optimizes the air intake. A check nut 55 is used to lock the screw in position. The side view of FIG. 4 shows the screw adjusted so that the door opens approximately 45°. The door 45 must be made heavy enough so that the aforementioned suction caused by chimney convection currents during periods of non-operation will not be sufficient to open the door.

It should be apparent that the structure described provides an effective, reliable, safe and inexpensive solution to the problem.

While the invention has been described in connection with an illustrative embodiment, modifications thereto are possible without departing from the disclosed inventive concept, accordingly the invention should be limited only by the scope of the appended claims.

I claim:

1. An energy conservation damper adapted for easy attachment to an oil burning furnace equipped with a combustion air blower which includes an air intake comprising an array of holes around a cylindrical frame, said damper comprising a sheet metal chamber of rectangular cross section, the broad sidewalls thereof having semicircular recesses therein and the narrow sidewalls having extended portions bent in a complimentary semicircle to form a circular recess adapted to be clamped over said array of holes so that said blower must obtain its supply of air through said chamber, the lower narrow sidewall of said chamber comprising a trap door type valve adapted to automatically open in response to the suction from operation of said blower and to automatically close upon de-energization of said blower, due to the force of gravity.

* * * * *